US011071664B2

(12) United States Patent
Tu

(10) Patent No.: US 11,071,664 B2
(45) Date of Patent: Jul. 27, 2021

(54) WHEELCHAIR FOR TRANSFERRING A PATIENT TO AN AUTOMOBILE

(71) Applicant: Cong Thanh Diep Tu, Ho Chi Minh (VN)

(72) Inventor: Cong Thanh Diep Tu, Ho Chi Minh (VN)

(73) Assignee: Ton Duc Thang University, Ho Chi Minh (VN)

( * ) Notice: Subject to any disclaimer, the term of this patent is extended or adjusted under 35 U.S.C. 154(b) by 0 days.

(21) Appl. No.: 15/607,442

(22) Filed: May 27, 2017

(65) Prior Publication Data

US 2021/0052443 A1 Feb. 25, 2021

(51) Int. Cl.

| | |
|---|---|
| ***A61G 3/02*** | (2006.01) |
| ***A61G 5/04*** | (2013.01) |
| *A61G 5/00* | (2006.01) |
| *A61G 5/10* | (2006.01) |

(52) U.S. Cl.

CPC ..... *A61G 3/02* (2013.01); *A61G 5/04* (2013.01); *A61G 5/003* (2013.01); *A61G 5/1059* (2013.01)

(58) Field of Classification Search

CPC ..... A61G 5/04; A61G 5/003; A61G 5/1059; A61G 5/00; A61G 5/021; A61G 5/022; A61G 5/046; A61G 5/047; A61G 5/128; A61G 3/0245; A61G 3/0272; A61G 3/0281; A61G 3/029; A61G 3/02; A61G 2200/14

See application file for complete search history.

(56) References Cited

U.S. PATENT DOCUMENTS

| | | | | |
|---|---|---|---|---|
| 5,096,008 A * | 3/1992 | Mankowski | A61G 5/042 | 180/6.5 |
| 5,388,289 A * | 2/1995 | Casperson | A61G 5/00 | 280/250.1 |
| 5,884,929 A * | 3/1999 | Kincaid | A61G 5/1072 | 280/304.1 |
| 6,325,399 B1 * | 12/2001 | DeMoss | A61G 5/1059 | 280/250.1 |
| 6,508,319 B1 * | 1/2003 | Langenfeld | A61G 5/04 | 180/65.1 |
| 8,935,814 B1 * | 1/2015 | Tu | A61G 7/1067 | 5/81.1 R |
| 9,565,947 B2 * | 2/2017 | Oblak | A63B 23/0405 | |
| 2015/0056050 A1 * | 2/2015 | Decuir, Jr. | A61G 7/1046 | 414/550 |

* cited by examiner

*Primary Examiner* — Glenn F Myers

(57) ABSTRACT

A wheelchair for transferring a patient to an automobile is disclosed that comprises: a base assembly; a first motor, a second motor, and a third motor connected to the base assembly; the first motor is configured to move the wheelchair around during a normal operating mode, the second motor is configured to provide stability to the wheelchair during a patient transferring mode; and a seating assembly having a fixed seat section and a movable seat section which are separated from each other during the patient transferring mode.

17 Claims, 11 Drawing Sheets

WHEELCHAIR FOR TRANSFERRING A PATIENT TO AN AUTOMOBILE

FIELD OF THE INVENTION

The present invention relates generally to the field of medical devices. More specifically, the present invention relates to a wheelchair for transferring a patient to an automobile.

BACKGROUND ART

There has long been a need for assisting in the movement of a wheelchair-bound person into an automobile. Many such devices have been designed for use with vans having large door openings, in which the person is lifted by means of a lifting mechanism. However, such automobile needs to be modified with such lifting mechanism. The availability of such specialized automobiles is limited to serve the needs of the patients.

Other conventional wheelchairs include slings which are supported from hanging arms and which may position a person over an automobile then lower him/her person onto the seat. Because of the limited area provided for entrance into an automobile, it is exceedingly difficult to manoeuver such patient into the automobile with such wheelchairs. Furthermore, of course, there is the additional difficulty in placing a patient in such a sling and removing the sling after transport.

Therefore what is needed is a apparatus patient sit to stand that can overcome the above described problems.

SUMMARY OF THE INVENTION

Accordingly, an objective of the present invention is to provide a wheelchair for transferring a patient to an automobile is disclosed that comprises: a base assembly; a first motor, a second motor, and a third motor connected to the base assembly; the first motor is configured to move the wheelchair around during a normal operating mode, the second motor is configured to provide stability to the wheelchair during a patient transferring mode; and a seating assembly having a fixed seat section and a movable seat section which are separated from each other during the patient transferring mode.

Yet another objective of the present invention is to provide a method for transferring a patient from a wheelchair to an automobile that includes the steps of providing a double-layered seating assembly including a top seat section and a bottom seat section; using a first motor to move said wheelchair to said automobile during a normal operating mode; using a second motor to provide stability to the wheelchair; and using a third motor to separate the top seat section from the bottom seat section by moving the top seat section laterally toward e automobile while said bottom seat is remained fixed during the patient transferring mode.

These and other advantages of the present invention will no doubt become obvious to those of ordinary skill in the art after having read the following detailed description of the preferred embodiments, which are illustrated in the various drawing Figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
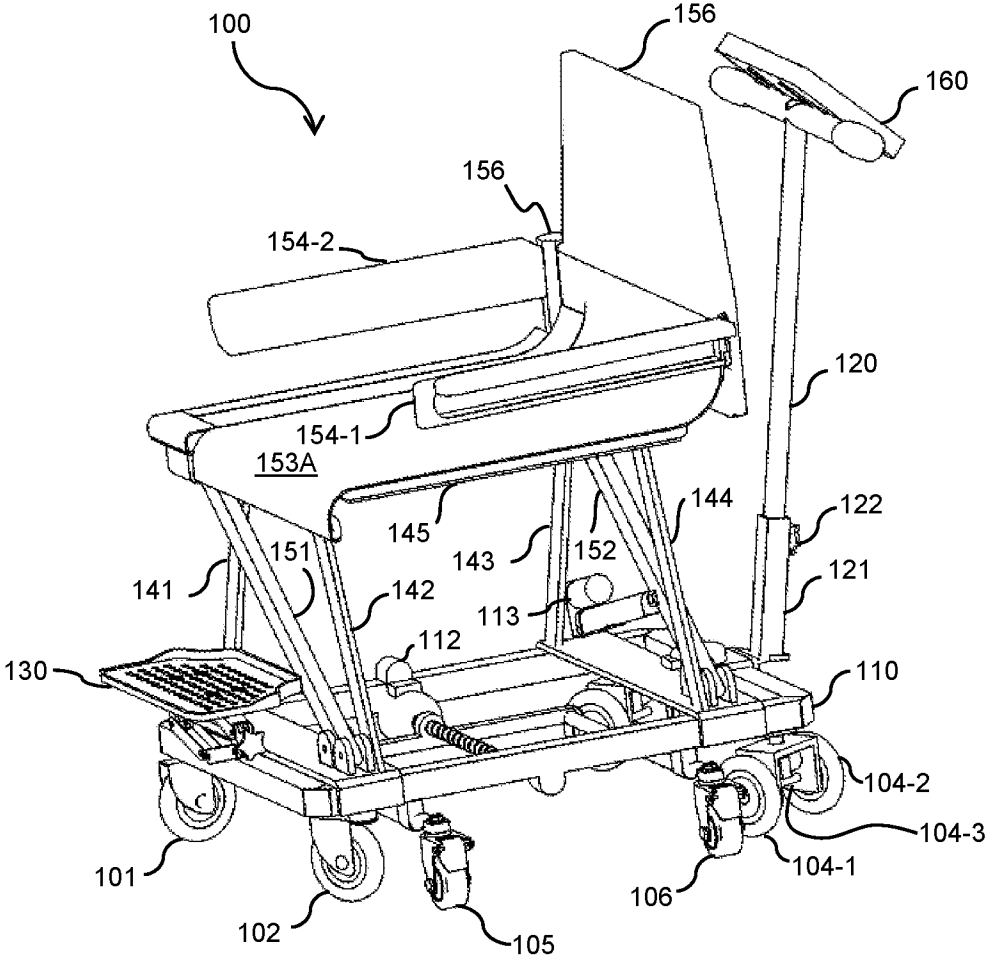
FIG. 1 is a diagram illustrating a wheelchair for transferring a patient to an automobile during a normal operation mode in accordance with an embodiment of the present invention.

One embodiment of the invention is now described with reference to FIG. 1 to FIG. 6. FIG. 1 illustrates a diagram of an apparatus 100 for transferring a patient to an automobile during a normal operating mode (hereinafter referred to as 'wheelchair 100'). In some embodiments, wheelchair 100 includes a base assembly 110 having a top side 110U and a bottom side 1108. On the bottom side 1108, base assembly 110 is mounted on a first caster wheel 101, a second caster wheel 102, a third caster wheel 103 (not seen in FIG. 1, please refer to FIG. 6), and a fourth caster wheel 104 (not seen in FIG. 1; see FIG. 6). First caster wheel 101 and second caster wheel 102 are connected to the front side of base 110 while third caster wheel 103 and fourth caster wheel are connected to the back side of base 110. In one exemplary embodiment, third caster wheel 103 further includes a first inverted U-shaped connector 103-3 that connects a first auxiliary wheel 103-1 and a second auxiliary wheel 103-2. Similarly, fourth caster wheel 104 further includes a second inverted U-shaped connector 104-3 that connects a first auxiliary wheel 104-1 and a second auxiliary wheel 104-2. Wheelchair 100 is designed to move around by means of a first motor 111. First motor 111 is placed in the middle of back side of base assembly 110 to drive third caster wheel 103 and fourth caster wheel 104. More specifically, in an illustrating embodiment, a pulley 111-1 is directly connected to first motor 111. A first connecting belt 111-2 connects third caster wheel 103 and pulley 111-1 together. A second connecting belt 111-3 connects fourth caster wheel 104 and pulley 111-1 together. With this arrangement, first motor 111 is responsible for the moving around of wheelchair 100 during the normal operating mode.

Referring again to FIG. 1 to FIG. 6 more specifically to FIG. 3 and FIG. 6, in another exemplary embodiment, to provide stability for a wheelchair 300 during the patient transferring mode, from a bottom view 600, base assembly 110 further comprises a first extendable leg 116-2 connected to a fifth caster wheel 105 and a second extendable leg 116-3 connected to sixth caster wheel 106. First extendable leg 116-2 and second extendable leg 116-3 are connected together by a connecting bar 116-1 perpendicular to the front end of base assembly 110. Evidently, first extendable leg 116-2 and second extendable leg 116-3 are forced to move in or out of base assembly 110 together. A threaded actuating arm 115 spans across the two sides, parallel to the front end and the back end of base assembly 110. A second motor 112 is secured on one side of base assembly 110, coupling to one end of threaded actuating arm 115. The other end of threaded actuating arm 115 is connected to the other side of base assembly 110. Threaded actuating arm 115 is coupled to connecting bar 116-1 by a threaded connector 115-1. In this exemplary embodiment, when second motor 112 is operated, it rotates threaded actuating arm 115 in one direction, extending first extendable leg 116-2 and second extendable leg 116-3 outward to provide counterweight for wheelchair 100. When the patient is transferred to an automobile, second motor 112 rotates in the opposite direction, retracting first extendable leg 116-2 and second extendable leg 116-3 back inside base assembly 110.

Continuing with FIG. 1, in another exemplary embodiment of the present invention, a footrest 130 is provided at the front side of base assembly 110 so that the patient to rest his or her feet thereupon. On the back side, a push handle 120 is connected to the middle back side of base assembly 100. In one embodiment, the length of push handle 120 is adjustable. Push handle 120 is further comprised of a first section 121 having a slightly larger cross section area than that of push handle 120 so that push handle 120 can be lowered inside first section 121. A fastener 122 is used to Hold push handle 120 at a fixed length. In another exemplary embodiment, a controller 160 is connected to the top of push handle 120 for controlling wheelchair 100. In many embodiments, push handle 120 is a T-shaped handle.

Figure 2:
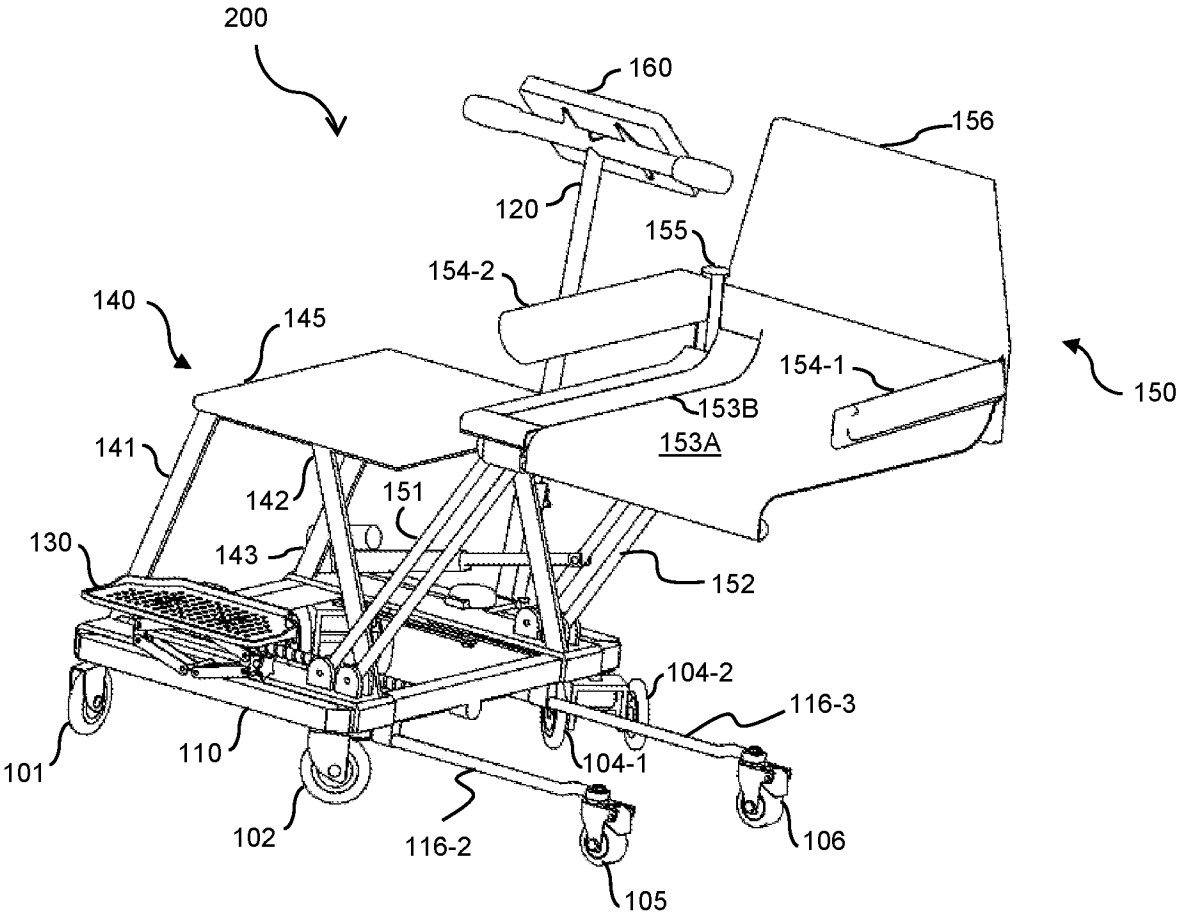
FIG. 2 is a diagram illustrating the wheelchair for transferring a patient to an automobile during a patient transferring mode in accordance with an embodiment of the present invention.
Figure 3:
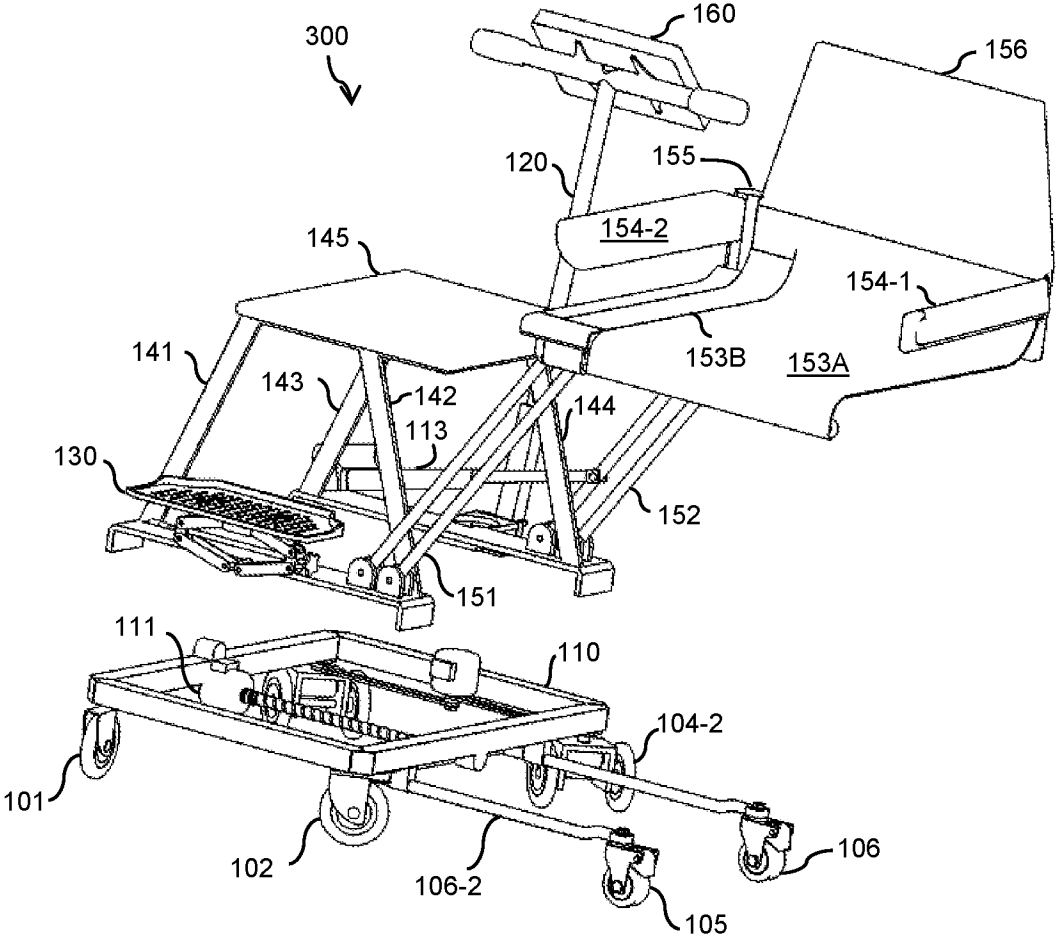
FIG. 3 is a diagram illustrating the wheelchair in the patient transferring mode when the fixed chair section and the movable chair section are removed from the base in accordance with an exemplary embodiment of the present invention.

Now referring to FIG. 2, a diagram illustrating a wheelchair 200 for transferring a patient to an automobile in the patient transferring mode in accordance with an exemplary embodiment of the present invention is illustrated. Wheelchair in patient transferring mode 200 (wheelchair 200) also includes a fixed seat section 140 and a movable seat section 150.

In most non-limiting exemplary embodiments of the present invention, movable seat section 150 is laid on top of fixed seat section 140 to form a chair unit for a patient to seat upon during the normal operating mode—wheelchair 100 functions as regular wheelchairs, i.e., moving a patient around. However, in the patient transferring mode, movable seat section 150 is separated from fixed seat section 140, transferring the patient toward an automobile (not shown in FIG. 1-FIG. 6). Fixed seat section 140 includes a first supporting leg 141, a second supporting leg 142, a third supporting leg 143, and a fourth supporting leg 144 fixedly connected to the four corners of base assembly 110. As shown in FIG. 2-FIG. 5, first supporting leg 141, second supporting leg 142, third supporting leg 143, and fourth supporting leg 144 all extend vertically upward from base assembly 110. Fixed seat section 140 also includes a first seat 145 fixedly connected to first supporting leg 141, second supporting leg 142, third supporting leg 143, and fourth supporting leg 144. In this exemplary embodiment, first seat 145 functions as a chair and a foundation for removable seat section 150 during the normal operating mode.

Continuing to FIG. 2-FIG. 5, movable seat section 150 includes a first rotating swivel arm 151, a second rotating swivel arm 152, and a second seat 153. In detail, first rotating swivel arm 151 is connected to the right front corner of base assembly 110 by a first swivel connector 151-1. Second rotating swivel arm 152 is connected to the right back corner of base assembly 110 by a second swivel connector 152-1. A second seat 153 is connected to first rotating swivel arm 151 and second rotating swivel arm 152. In an exemplary embodiment, first swivel connector 151-1 has a half-dome shape housing and a common axis (not shown) that is rotatably connected to first rotating swivel arm 151. Similarly, second swivel connector 152-1 has a half-dome shape housing and a common axis (not shown) that is rotatably connected to second rotating swivel arm 152. A third motor 113 is placed at the back side of base assembly 110 and connected to second rotating swivel arm 152. In an exemplary embodiment, third motor 113 is a linear motor that extend or withdraw second rotating swivel arm 152.

Figure 4:
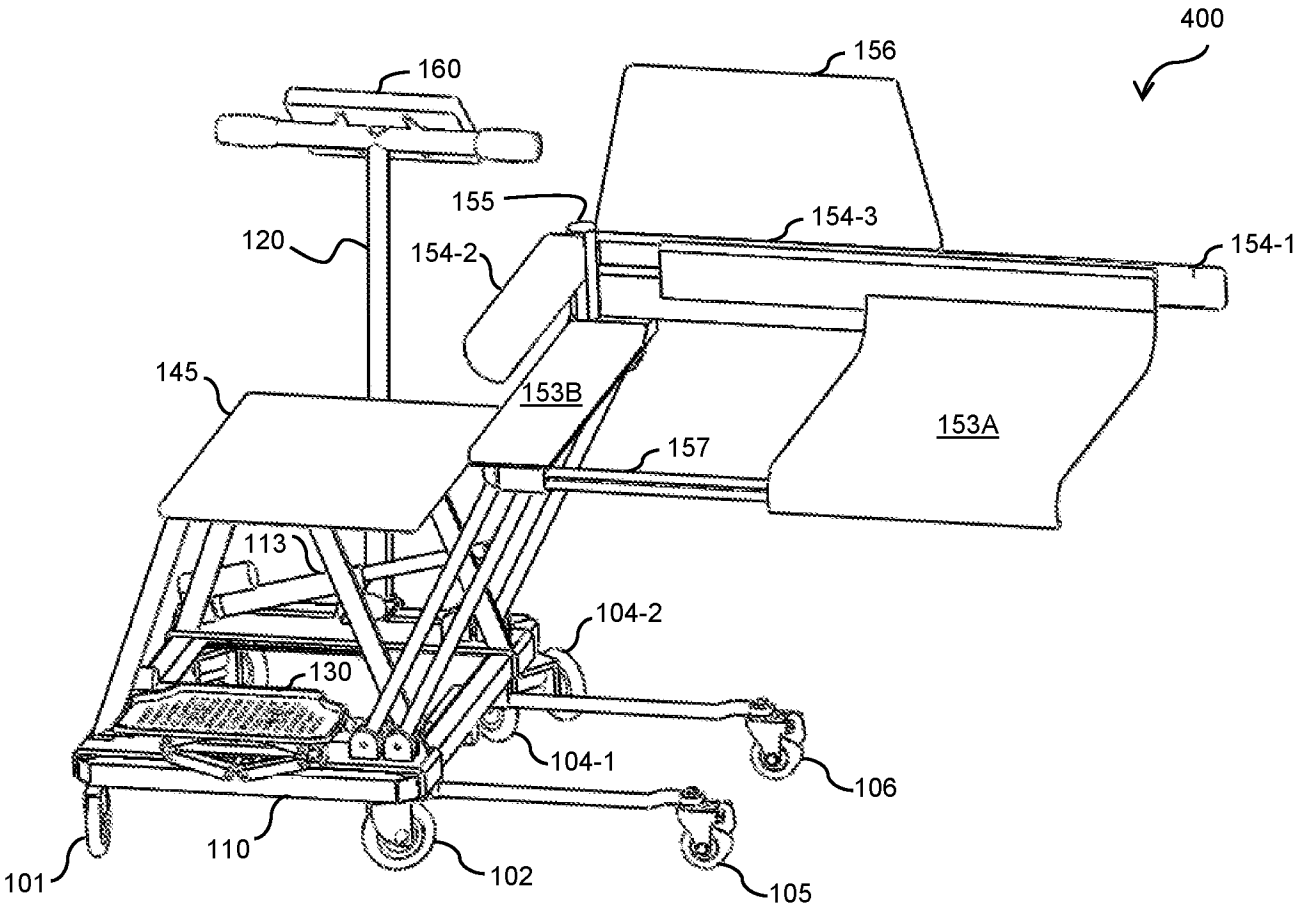
FIG. 4 is a diagram illustrating the wheelchair in the patient transferring mode when a seating assembly comprising a fixed seat section and a movable seat section are extended laterally outward toward the automobile in accordance with an exemplary embodiment of the present invention.

Continuing again with FIG. 2-FIG. 5 and more specifically to FIG. 4, a wheel chair 400 in the extended mode discloses second seat 153 which includes a back support 156, a foldable U-shaped arm rest 154 connected to back support 156. In an exemplary embodiment, foldable U-shaped arm rest 154 further includes a left arm rest 154-1, a right arm rest 154-2, and a back connecting bar 154-3. Left arm rest is connected with back connecting bar 154-3 by a hinge 154-4 that enables left arm rest to fold or unfold. during the patient transferring mode, foldable U-shaped arm rest 154 is configured to unfold on the left hand side into an L-shaped arm rest by hinge 154-4 so that said patient can move from said second seat to an automobile. Second seat 150 further includes a seat supporting frame 157 connected to first rotating swivel arm 151 and second rotating swivel arm 152. In an embodiment of the present invention, first rotating swivel arm 151 and second rotating swivel arm 152 each is made of a pair of parallel bars and handle connectors (not shown). Seat supporting frame 157 is releasably coupled to first rotating swivel arm 151 and second rotating swivel arm 152 by handle connectors (not shown). Handle connectors are well-known in the art and are not described in details there. The height of seat supporting frame 157 relative to the automobile can be adjusted by flipping the handles of handle connectors (not shown) and move seat supporting frame 157 up or down to achieve a preferred height (relative to the automobile or other areas such as a bed). Finally, handle connectors are locked in order to maintain second seat 153 at the preferred height. In other exemplary embodiments of the present invention, first rotating swivel arm 151 and second rotating swivel arm 152 are telescoping tubes controlled by a pair of motors (not shown).

Figure 5:
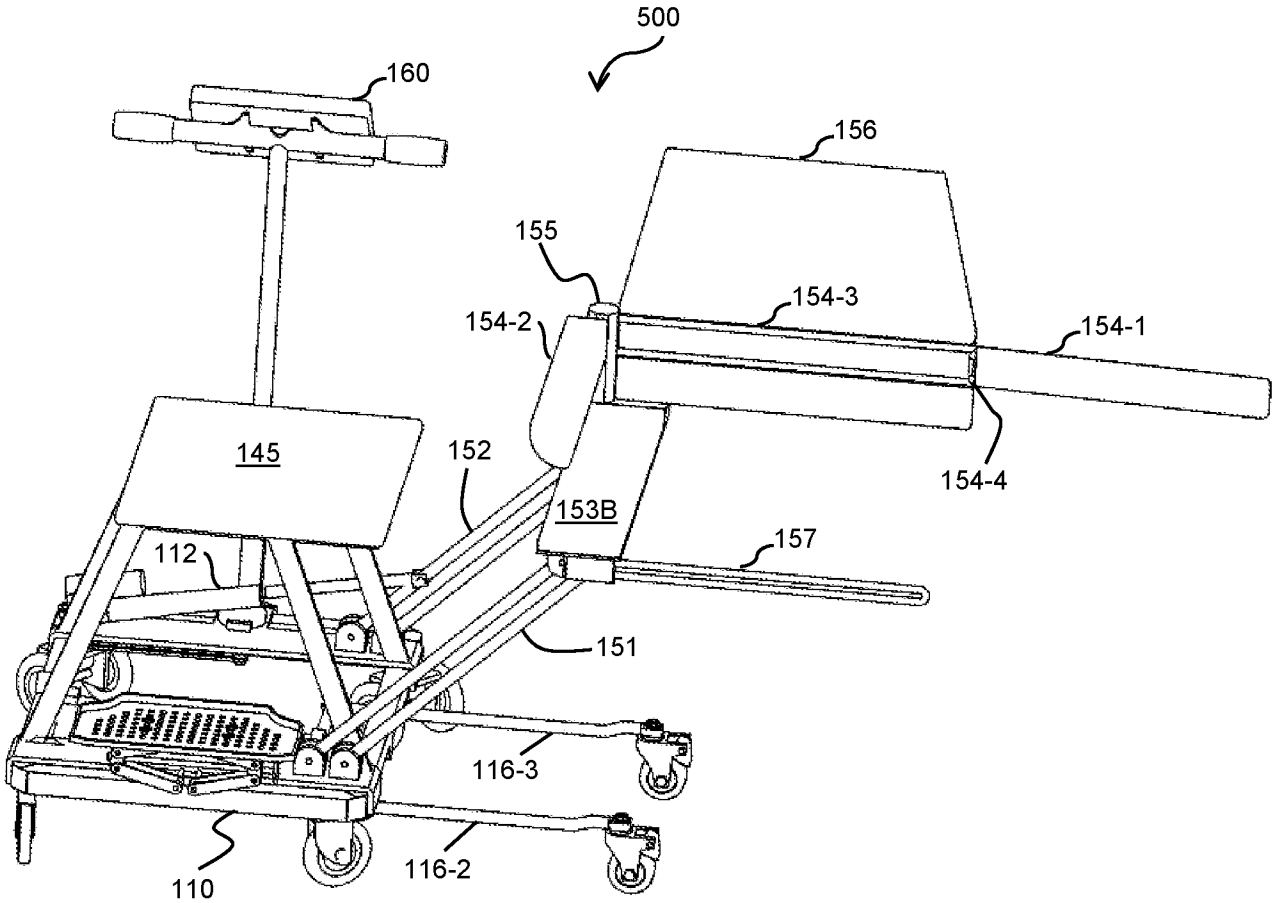
FIG. 5. is a diagram illustrating the wheelchair after the patient is successfully transferred to the automobile in accordance with an exemplary embodiment of the present invention.

Still referring to FIG. 2-FIG. 5 more specifically to FIG. 5, a wheel chair 500 is disclosed which includes a separable seat unit 153A-153B is coupled to seat supporting frame 157 and to foldable U-shaped arm rest 154. In some exemplary embodiments, separable seat unit 153A-153B is comprised of a fixed seat base 153B and a flexible seat base. Fixed seat base 153B is connected to seat supporting frame 157, said back support 156, and foldable U-shaped armrest 154. Flexible seat base 153A is removably coupled to seat supporting frame 157 and to foldable U-shaped armrest 154. Flexible seat base 153A is made of soft materials such as cloth, plastic, plush, etc. and configured to be removed from second seat 153 and brought into said automobile with the patient during the patient transferring mode.

Now referring to FIG. 7-FIG. 11, the operation of wheelchair 100 in a normal operating mode and wheelchair 200 during the patient transferring mode are described in details with a controller 160.

Figure 6:
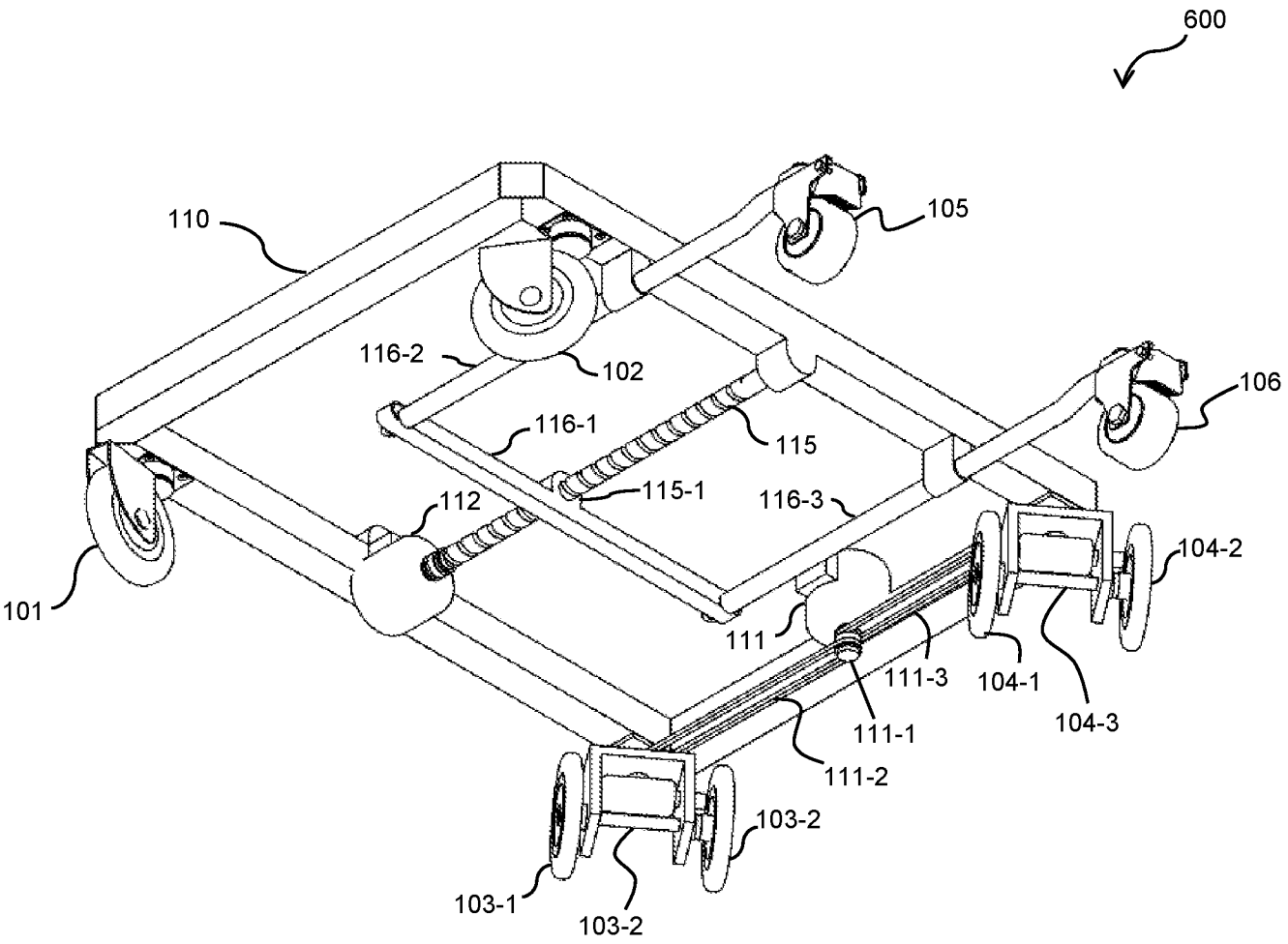
FIG. 6 is a 3D diagram illustrating a bottom view of the base assembly of the wheelchair for transferring a patient to an automobile in accordance with an exemplary embodiment of the present invention.
Figure 7:
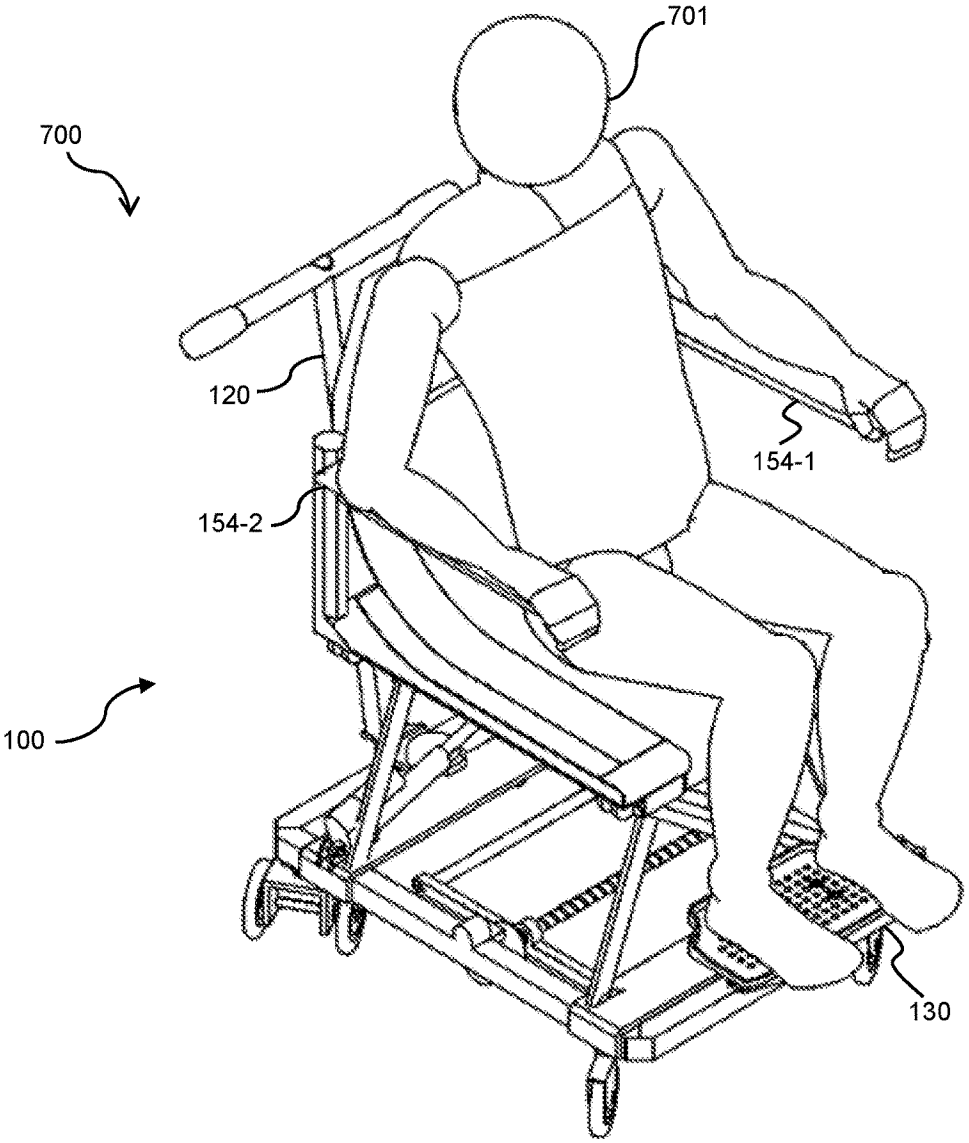
FIG. 7 is a diagram illustrating the wheelchair with a patient during a normal operating mode in accordance with an exemplary embodiment of the present invention.

Referring now to FIG. 7, a diagram 700 of wheelchair 100 described in FIG. 1 and FIG. 6 in a normal operating mode is illustrated. In the normal operating mode, wheelchair 100 is functioned as a normal wheelchair designed to move a patient 701 around. In some exemplary embodiments, wheelchair 100 can be operated in either manual mode or automatic mode with controller 160. That is, in the normal operating mode of moving patient 701 around is complete with the assistance of aids or nurses without using first motors 111, second motor 112, and third motor 113. Patient 701 can rest his or her feet on footrest 130. Both arms of patient 701 can be comfortably rested on left arm rest 154-1 and right arm rest 154-2. Push handle 120 is used by either a nurse or an assistant to move patient 701 around during normal operating mode.

Figure 8:
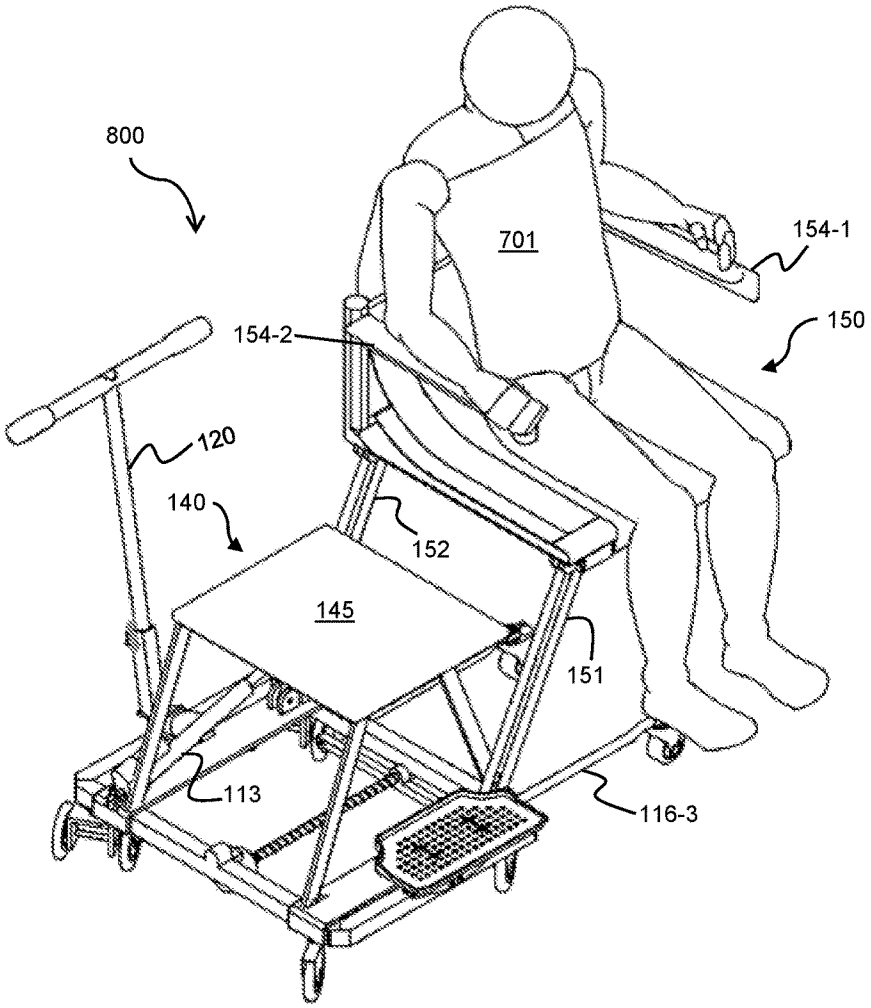
FIG. 8 a diagram illustrating the wheelchair with a patient during the patient transferring mode in accordance with an exemplary embodiment of the present invention.

Next, referring to FIG. 8, a diagram 800 of wheelchair 200 during the patient transferring mode is illustrated. As described above in FIG. 1 to FIG. 6, during the patient transferring mode, movable seat section 150 is separated from fixed seat section 140 by means of third motor 113. Third motor 113 is operated to expand its piston arm to push second rotating swivel arm 152 outward toward the automobile. In an exemplary and non-limiting embodiment, second rotating swivel arm 152 can be rotated outward to separate fixed seat section 140 from movable seat section 150 using manual assistance from a nurse or an assistant. In another word, the patient transferring mode can be achieved by a manual mode without using third motor 113.

Figure 9:
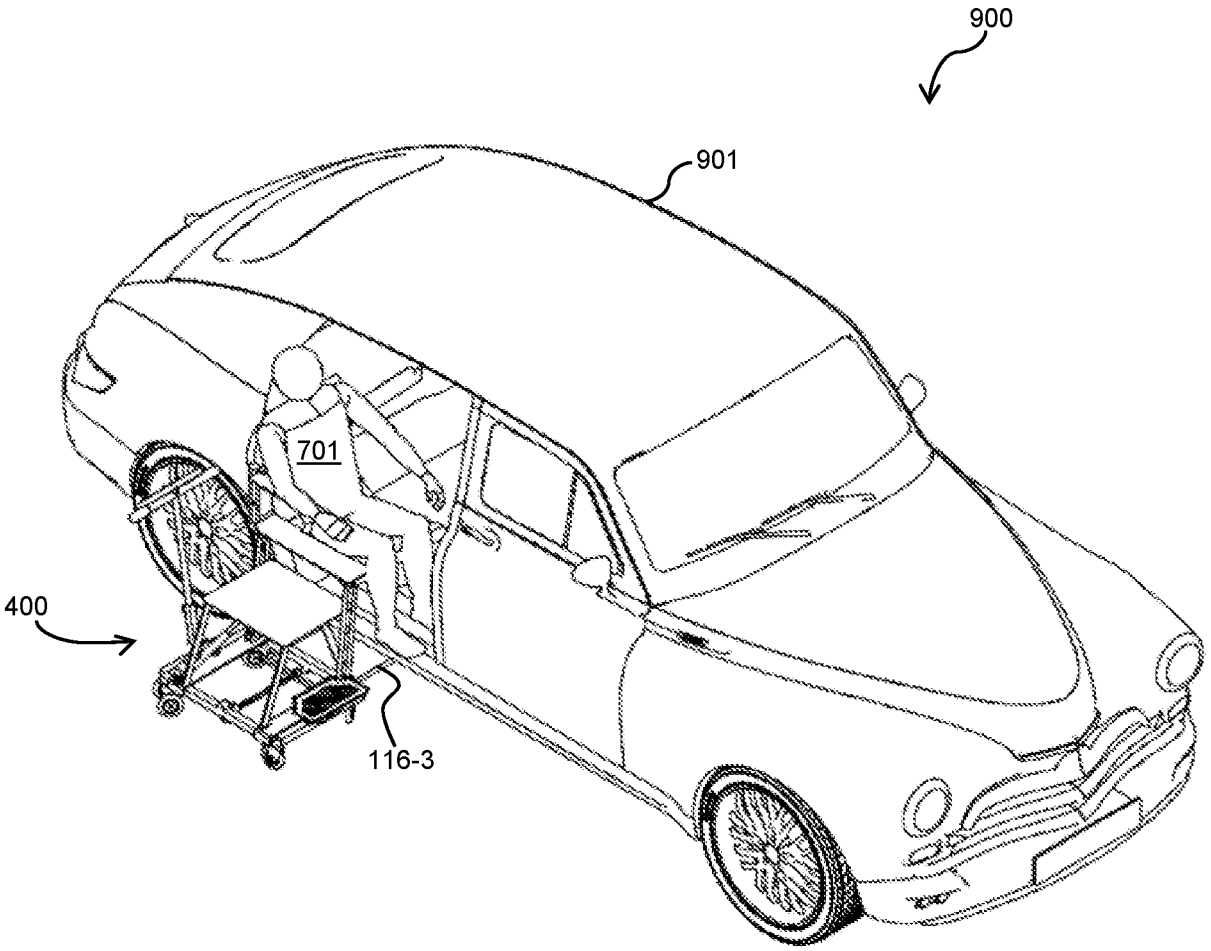
FIG. 9 is a diagram illustrating the wheelchair with a patient being moved toward the automobile during the patient transferring mode in accordance with an exemplary embodiment of the present invention.

Now referring to FIG. 9, a diagram 900 illustrating wheelchair 200 at the beginning of the patient transferring mode is illustrated. After wheelchair 200 is parked next to an automobile 901, the patient transferring mode begins as described in FIG. 1-FIG. 8.

Figure 10:
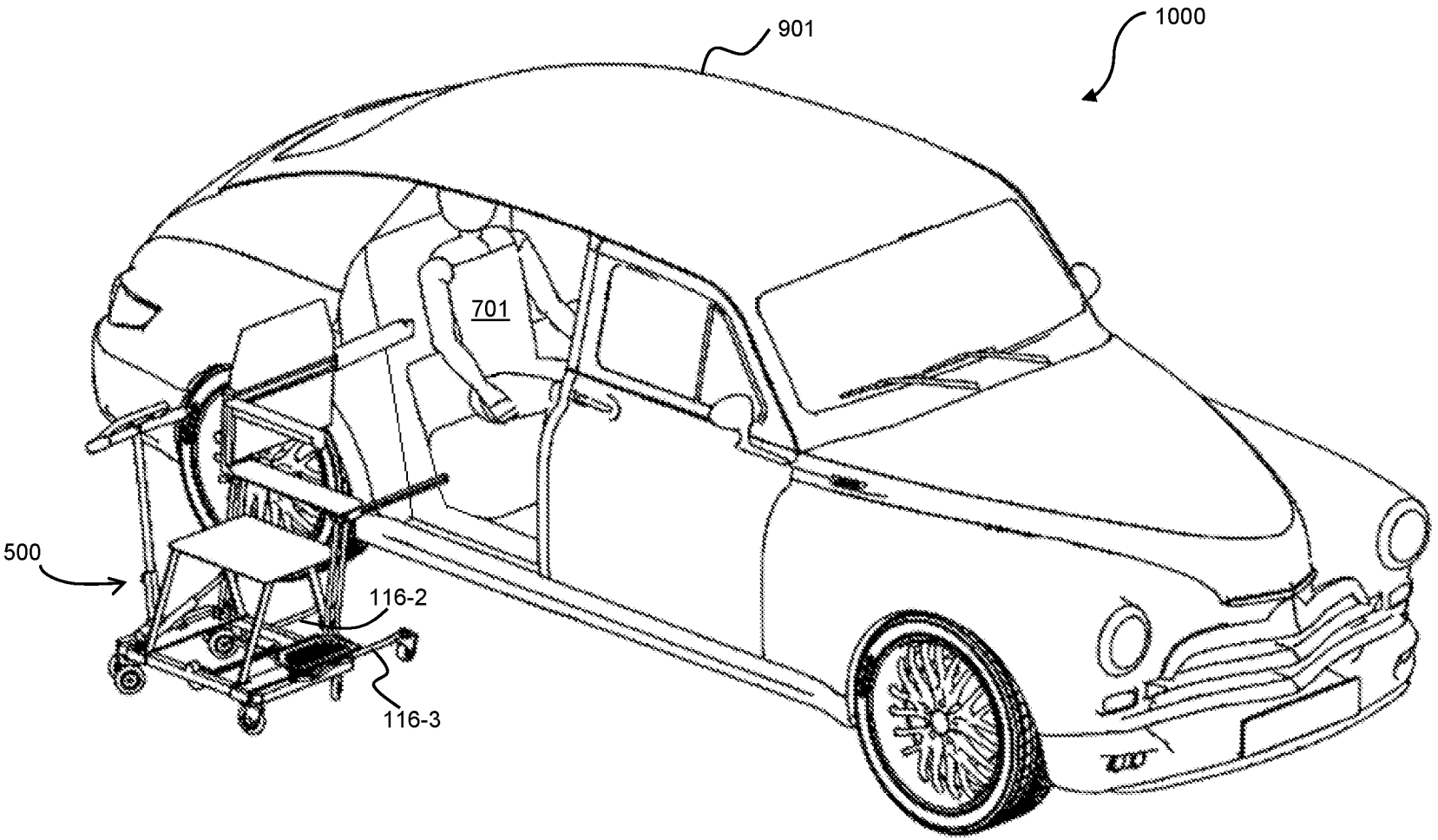
FIG. 10 is a diagram illustrating the wheelchair with a patient after being successfully moved inside the automobile during the patient transferring mode in accordance with an exemplary embodiment of the present invention

FIG. 10 is a diagram 1000 illustrating the completion of the patient transferring mode. In an exemplary embodiment of the present invention, as described in FIG. 5, as patient 701 is moved into automobile 901, flexible seat base 153A is separated from fixed seat base 153B and moved with patient 701. Yet in another exemplary embodiment, after patient 701 is successfully moved into automobile 901, wheelchair 200 can be folded down to base assembly 110 to fit in the trunk of automobile 901. When arriving at the destination, the folded wheelchair can be erected back into wheelchair 200. Flexible seat base 153A is helpful in moving patient back into wheelchair 200. Flexible seat base 153A is removed from under patient 701, coupled back to fixed seat base 153B. Then patient 701 is moved out of automobile 901 to seat on second seat 150. At this point, the patient transferring mode ends, and the normal operating mode begins. Wheelchair 200 now becomes wheelchair 100 to move patient 701 around.

Figure 11:
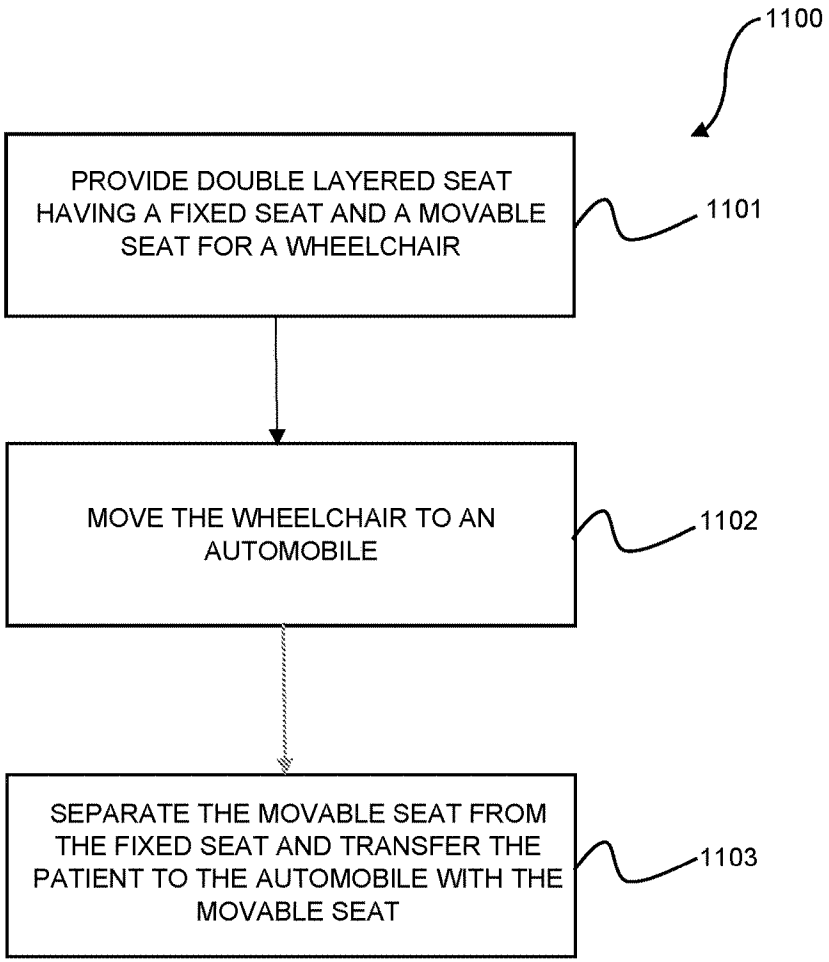
FIG. 11 is a flow chart illustrating a method for transferring a patient from a wheelchair to an automobile in accordance with an exemplary embodiment of the present invention.

Now referring to FIG. 11, a method 1100 for transferring a patient from a wheel chair to an automobile is illustrated in accordance with an exemplary embodiment of the present invention.

At step 1101, a double layered seat is provided for a wheelchair. The double layered seat is comprised of a fixed seat and a movable seat. In the present invention, step 1101 is realized by a fixed seat 140 and a movable seat 150. The movable seat is actuated by third motor 113 when the transfer begins.

Then at step 1102, the double layered seat wheelchair is moved to an automobile. Step 1102 is performed by wheelchair 100 and first motor 111.

At step 1103, the movable seat is separated from the fixed seat and the patient is transferred to the automobile with the movable seat. Step 1103 is realized by wheelchair 200 described above in FIG. 2 to FIG. 5, FIG. 7 to FIG. 10. In some exemplary embodiments, step 1103 is accomplished by third motor 113.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

DESCRIPTION OF NUMERALS

100 wheelchair in normal operating mode
110 base assembly
101 first caster wheel
102 second caster wheel
103 third caster wheel
103-1 first auxiliary wheel
103-2 second auxiliary wheel
103-3 first inverted U-shaped connector

104 fourth caster wheel
104-1 third auxiliary wheel
104-2 fourth auxiliary wheel
104-3 second inverted U-shaped connector
105 fifth caster wheel
106 sixth caster wheel
111 first motor
111-1 pulley
111-2 first connecting belt
111-3 second connecting belt
112 second motor
113 third motor
115 threaded actuating arm
115-1 threaded connector
116-1 connecting bar
116-2 first extendable leg
116-3 second extendable leg
120 push handle
121 base handle section
122 length adjusting connector
130 foot rest
140 fixed seat section
141 first supporting leg
142 second supporting leg
143 third supporting leg
144 fourth supporting leg
145 first seat
150 movable seat section
151 first rotating swivel arm
151-1 first swivel connector
152 second rotating swivel arm
152-1 second swivel connector
153 second seat
153AB separable seat unit
153A flexible seat base
153B fixed seat base
154 Foldable U-shaped arm rest
154-1 left arm rest
154-2 right arm rest
154-3 back connecting bar
154-4 hinge
155 armrest connector
156 back support
157 seat supporting frame
160 controller
300 wheel chair as telescopic legs extend
400 wheel chair as seat opening up
500 successfully transferred wheel chair
600 base assembly of the wheel chair
700 wheel chair in the non-transferring mode
701 patient
901 automobile

What is claimed is:

1. An apparatus for transferring a patient from a wheelchair to an automobile, comprising:

a base assembly comprising a front side, a back side, a left side, and a right side;

a first motor, a second motor, and a third motor connected to said base assembly, wherein said first motor is configured to transport said patient on said apparatus during a normal operating mode, and wherein said second motor is operable to provide stability to said apparatus during a patient transferring mode;

a double-layered seating assembly having a fixed seat section and a movable seat section mechanically connected to the top side of said base assembly, wherein said movable seat section where said patient directly sits upon is folded on top of said fixed seat section during said normal operating mode, and wherein said third motor is configured to separate said movable seat section laterally outward from said fixed seat section so as to move said patient to said automobile during said patient transferring mode; and a threaded actuating arm connected to said first motor which is fastened to the middle of said left side, said threaded actuating arm connected to said second motor, to the middle of said connecting bar, and to said right side of said base assembly, said second motor is operable to rotate said threaded actuating arm which extends a fifth caster wheel and a sixth caster wheel outward during said patient transferring mode and to rotate said threaded actuating arm in a second direction to retract said fifth caster wheel and said sixth caster wheel back inside said base assembly during said normal operating mode.

2. The apparatus of claim 1 further comprising:

a first caster wheel, a second caster wheel, a third caster wheel, and a fourth caster wheel, wherein said first caster wheel, said second caster wheel, said third and said fourth caster wheels are arranged from front to back at four corners of a bottom side of said base assembly respectively.

3. The apparatus of claim 2 wherein said first caster wheel and said second caster wheel are connected to the corners of said front side, and said third caster wheel and said fourth caster wheel are connected to the corners of said back side.

4. The apparatus of claim 3 wherein third caster wheel and said fourth caster wheel each further comprises a pair of auxiliary wheels connected together by an inverted U-shaped connector rotatably connected to said base assembly.

5. The apparatus of claim 4 further comprises:

a first extendable leg and a second extendable leg, wherein said fifth caster wheel is connected to said first extendable leg and said sixth caster wheel is connected to said second extendable leg, and said first extendable leg and said second extendable leg are connected together by a connecting bar perpendicular to said front side and said back side of said base assembly.

6. The apparatus of claim 5 wherein said fifth caster wheel and said sixth caster wheel are extended during said patient transferring mode and retracted during said normal mode in a direction perpendicular to said left side and said right side of said base assembly.

7. The apparatus of claim 4 further comprises a foot rest connected to said front side of said base assembly.

8. The apparatus of claim 5 further comprising a controller connected to a push handle connected to said back side of said base assembly, wherein said push handle is telescopically extended in a vertical direction to adjust a height of said push handle; and wherein said push handle is mechanically connected to control the moving direction of said third caster wheel and fourth caster wheel.

9. The apparatus of claim 6 wherein said first motor is connected to said back side operable to control the operation of said third caster wheel and fourth caster wheel.

10. The apparatus of claim 7 wherein said fixed seat section further comprises:

a first supporting leg, a second supporting leg, a third supporting leg, and a fourth supporting leg fixedly connected to the corners of said front side and said back side of said base assembly, wherein said first supporting leg, said second supporting leg, said third supporting leg, and said fourth supporting leg all extend vertically upward from said base assembly; and a first seat fixedly connected to said first supporting leg, said second supporting leg, said third supporting leg, and said fourth supporting leg.

11. The apparatus of claim 8 wherein said movable seat section further comprises:

a first rotating swivel arm connected to said front side;

a second rotating swivel arm connected to said back side;

a second seat connected to said first rotating swivel arm and said second rotating swivel arm.

12. The apparatus of claim 11 wherein said first rotating swivel arm is connected to the right corner of said front side by a first swivel connector and said second rotating swivel arm is connected to the right corner of said back side by a second swivel connector.

13. The apparatus of claim 10 wherein said third motor connected to the left corner of said back side and to said second rotating swivel arm, said third motor is operable to push said second rotating swivel arm outward during said patient transferring mode and to retract said second rotating swivel arm so that said second seat is aligned on top of said first seat during said normal operating mode.

14. The apparatus of claim 11 wherein said second seat further comprises:

a back support;

foldable U-shaped arm rest, connected to said back support, configured to unfold one side into an L-shaped arm rest during said patient transferring mode so that said patient can move from said second seat to said automobile; and a seat supporting frame connected to said first rotating swivel arm and said second rotating swivel arm; and a separable seat unit coupled to said seat supporting frame and to said foldable U-shaped arm rest.

15. The apparatus of claim 12 wherein said separable seat unit further comprises:

a fixed seat base connected to seat supporting frame, said back support, and said foldable U-shaped armrest; and a flexible seat base, removably coupled to said seat supporting frame and said foldable U-shaped armrest, configured to be removed from said second seat and said foldable U-shaped armrest into said automobile with said patient during said patient transferring mode.

16. The apparatus of claim 13 further comprises a controller connected to said push handle operable to control said first motor, said second motor, and said third motor.

17. The apparatus of claim 11 wherein said controller is operative to:

control said first motor to cause said first caster wheel, said second caster wheel, said third caster wheel, and said fourth caster wheel to go forward, turn left, turn right, or go backward during said normal operating mode;

control said second motor to cause said fifth wheel and said sixth wheel to extend so as to provide a counter weight for said apparatus during said patient transferring mode; and control said third motor to cause said first rotating swivel arm and said second rotating swivel arm to rotate outward during said patient transferring mode and to rotate backward during said normal operating mode.

* * * * *